US011944163B1

(12) United States Patent
Wu

(10) Patent No.: US 11,944,163 B1
(45) Date of Patent: Apr. 2, 2024

(54) SHOELACE

(71) Applicant: JHIH HUEI TRADING CO., LTD., Changhua County (TW)

(72) Inventor: Yung-Yu Wu, Changhua County (TW)

(73) Assignee: JHIH HUEI TRADING CO., LTD., Fuxing Township, Changhua County (TW)

( * ) Notice: Subject to any disclaimer, the term of this patent is extended or adjusted under 35 U.S.C. 154(b) by 0 days.

(21) Appl. No.: 18/153,265

(22) Filed: Jan. 11, 2023

(51) Int. Cl.
*A43C 9/00* (2006.01)

(52) U.S. Cl.
CPC ..... *A43C 9/00* (2013.01)

(58) Field of Classification Search
CPC ..... A43C 9/00
See application file for complete search history.

(56) References Cited

U.S. PATENT DOCUMENTS 4,858,282 A * 8/1989 DuPont, Jr. ..... A43C 9/00 24/712
5,826,421 A * 10/1998 Wilcox ..... A47L 13/20 87/5
6,796,008 B1 * 9/2004 Huang ..... A43C 9/00 24/712.1
8,931,146 B2 * 1/2015 Stanev ..... A43C 9/00 24/712
2006/0168785 A1 * 8/2006 Kraft ..... A43C 9/00 24/715.3
2009/0144953 A1 * 6/2009 Tsai ..... A43C 9/00 24/712
2012/0144631 A1 * 6/2012 Stanev ..... D04C 1/12 24/712
2013/0269210 A1 * 10/2013 Woods ..... A43C 9/00 36/50.1
2019/0246744 A1 * 8/2019 Torres ..... A43C 7/00

* cited by examiner

*Primary Examiner* — David M Upchurch

(74) *Attorney, Agent, or Firm* — Muncy, Geissler, Olds & Lowe. P.C.

(57) ABSTRACT

A shoelace is provided, including: a core material and a cover layer. The core material defines an axial direction, and the cover layer is sleeved on the core material. The cover layer covers 30% to 90% of an area of an outer peripheral surface of the core material. Therefore, the shoelace has a concave-convex outer surface and is not easy to loosen when tied, and provides good structural strength and appearance.

6 Claims, 1 Drawing Sheet

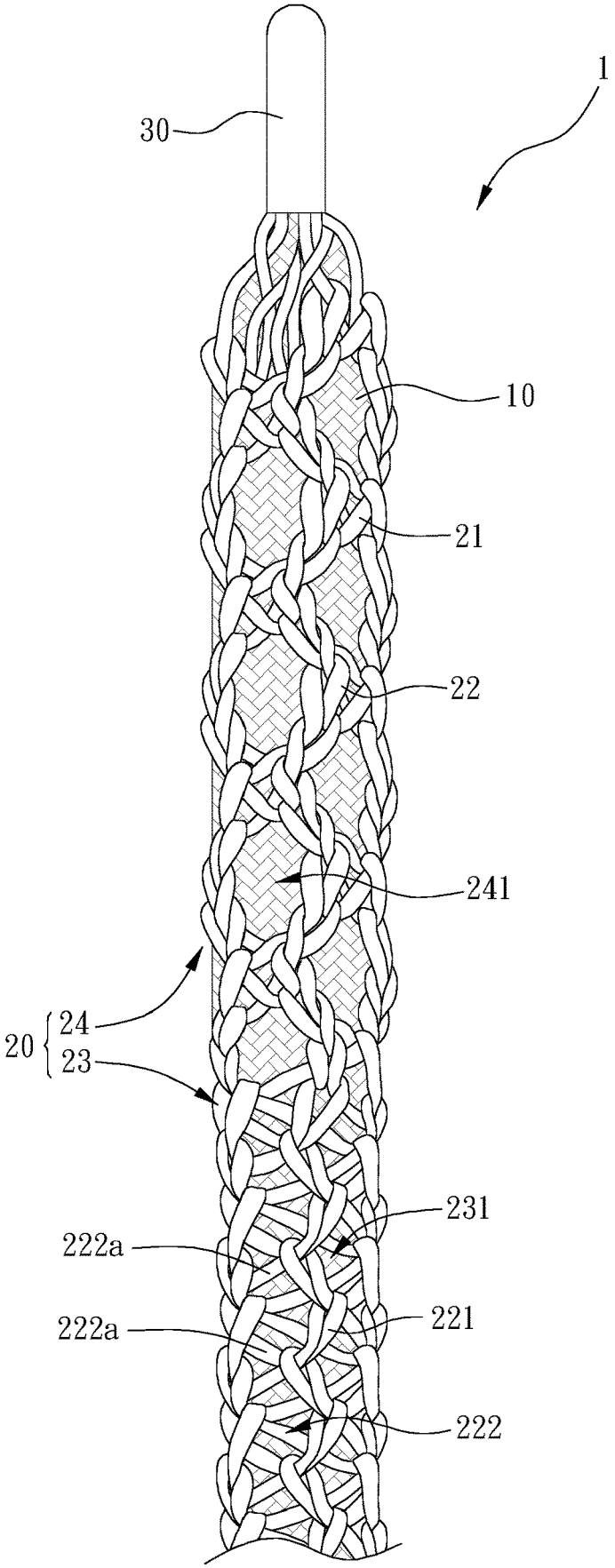
1
30
10
21
22
241
20
24
23
231
222a
222a
221
222

SHOELACE

BACKGROUND OF THE INVENTION

Field of the Invention

The present invention relates to a shoelace.

Description of the Prior Art

A conventional shoelace is woven by a plurality of strands, and an appearance of the shoelace can only be changed by changing the weaving method or color of the plurality of strands, which limits the variability of the shoelace and requires complicated processing steps. In addition, the conventional shoelace is generally formed as a flat rope or round rope with a smooth outer surface that provides insufficient friction force so that the shoelace is easy to loosen when tied. The conventional shoelace also has insufficient structural strength and poor durability.

The present invention is, therefore, arisen to obviate or at least mitigate the above-mentioned disadvantages.

SUMMARY OF THE INVENTION

The main object of the present invention is to provide a shoelace, which is not easy to loosen when tied and provides good structural strength and preferable appearance.

To achieve the above and other objects, the present invention provides a shoelace, including: a core material, defining an axial direction; and a cover layer, sleeved on the core material. The cover layer covers 30% to 90% of an area of an outer peripheral surface of the core material.

The present invention will become more obvious from the following description when taken in connection with the accompanying drawings, which show, for purpose of illustrations only, the preferred embodiment(s) in accordance with the present invention.

BRIEF DESCRIPTION OF THE DRAWINGS

The FIGURE is a stereogram of a preferable embodiment of the present invention.

DETAILED DESCRIPTION OF THE PREFERRED EMBODIMENTS

Please refer to the FIGURE for a preferable embodiment of the present invention. A shoelace 1 of the present invention includes a core material 10 and a cover layer 20.

The core material 10 defines an axial direction. The cover layer 20 is sleeved on the core material 10, and the cover layer 20 covers 30% to 90% of an area of an outer peripheral surface of the core material 10. Therefore, the cover layer 20 provides a discontinuous outer surface to the shoelace 1 so that the shoelace 1 has special visual effect and sufficient structural strength, and is not easy to loosen when tied.

The cover layer 20 includes a plurality of strands 21 which are knitted with one another and forms a plurality of loops 22 sleeved with one another. Each of the plurality of strands 21 continuously extends between two opposite ends of the core material 10 so as to have good structural strength. In this embodiment, the plurality of loops 22 partially forms a plurality of rib portions 221 and a plurality of connecting portions 222. The plurality of rib portions 221 extend in the axial direction and spacingly arranged around the core material 10, and each of the plurality of connecting portions 222 is connected between adjacent two of the plurality of rib portions 221. Each of the plurality of connecting portions 222 includes a plurality of linear segments 222*a* extending in different directions so that the cover layer 20 can stably enclose the core material 10 and provides special visual effect and good abrasion resistance on the plurality of ribs 221.

Specifically, the cover layer 20 includes at least one first section 23 and at least one second section 24 connected with one another. In per unit length of the core material 10, an area that each said first section 23 covering the outer peripheral surface of the core material 10 is larger than an area that one said second section 24 covering the outer peripheral surface of the core material 10. For example, the cover layer 20 may include a plurality of the first section 23 and a plurality of the second section 24 alternatively arranged in the axial direction; the cover layer 20 may include another knitting fabric structure between one said first section and one said second section. In per unit length of the core material 10, the area that each said first section 23 may cover 70% of the outer peripheral surface of the core material 10, and each said second section 24 may cover 40% of the outer peripheral surface of the core material 10, which provides special appearance and good structural strength. Each said first section 23 has a first diametrical dimension, and each said second section 24 has a second diametrical dimension larger than one said first diametrical dimension so that the at least one first section 23 and the at least one second section 24 provide different compressibility in a radial direction of the shoelace 1. Preferably, the at least one first section 23 and the at least one second section 24 are knitted differently; each said first section 23 includes a plurality of first meshes 231, and each said second section 24 includes a plurality of second meshes 241 larger than the plurality of first meshes 231. Diametrical dimensions of the plurality of second meshes 241 adjacent to one said first section 23 are smaller than diametrical dimensions of the plurality of second meshes 241 remote from the said first section 23. A diametrical dimension of each of the plurality of second meshes 241 is larger than or equal to ½ of a diameter of the core material 10 so that the outer surface of the shoelace 1 has obvious unevenness so as to provide sufficient frictional resistance, and the core material 10 can be exposed outwardly from the plurality of second meshes 241. An end of the shoelace 1 may penetrate through the plurality of second meshes 241 and be restricted between the core material 10 and the cover layer 20, and the excess of the shoelace 1 can be restricted without tying.

The shoelace 1 further includes two head portions 30, and the two head portions 30 are mounted to two opposite ends of the core material 10. Each of the two head portions 30 covers one of the at least one first section 23 and the at least one second section 24 for easy processing. For example, when one of the two head portions 30 covers one said first section 23, the portion of the plurality of strands 21 corresponding to the said first section 23 can evenly distribute force exerted thereon so as to have good wear-resistance effect and be not easy to break. When one of the two head portions 30 covers one said second section 24, the said second section 24 is easy to be compressed and said head portion 30 has a smaller diametrical dimension, which is easy to be disposed through part of the plurality of second meshes 241.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A shoelace, including:

a core material, defining an axial direction; and a cover layer, sleeved on the core material, the cover layer covering 30% to 90% of an area of an outer peripheral surface of the core material;

wherein the cover layer includes a plurality of strands which are knitted with one another and forms a plurality of loops sleeved with one another.

2. The shoelace of claim 1, wherein the plurality of loops partially form a plurality of rib portions and a plurality of connecting portions, the plurality of rib portions extend in the axial direction and spacingly arranged around the core material, each of the plurality of connecting portions is connected between adjacent two of the plurality of rib portions, and each of the plurality of connecting portions includes a plurality of linear segments extending in different directions.

3. The shoelace of claim 1, wherein the cover layer includes at least one first section and at least one second section connected with one another, and the at least one first section and the at least one second section are knitted differently.

4. The shoelace of claim 1, wherein the cover layer includes at least one first section and at least one second section connected with one another, and each said first section has a first diametrical dimension, and each said second section has a second diametrical dimension larger than one said first diametrical dimension.

5. The shoelace of claim 1, wherein the cover layer includes at least one first section and at least one second section connected with one another, and each said first section includes a plurality of first meshes, each said second section includes a plurality of second meshes larger than the plurality of first meshes, and diametrical dimensions of the plurality of second meshes adjacent to one said first section are smaller than diametrical dimensions of the plurality of second meshes remote from the said first section.

6. The shoelace of claim 5, wherein a diametrical dimension of each of the plurality of second meshes is larger than or equal to ½ of a diameter of the core material.

* * * * *